US005312703A

United States Patent [19]

Wagenblast et al.

[11] Patent Number: 5,312,703

[45] Date of Patent: May 17, 1994

[54] REVERSIBLE OR IRREVERSIBLE PRODUCTION OF AN IMAGE

[75] Inventors: Gerhard Wagenblast, Frankenthal; Volker Bach, Neustadt, both of Fed. Rep. of Germany

[73] Assignee: BASF Aktiengesellschaft, Ludwigshafen, Fed. Rep. of Germany

[21] Appl. No.: 838,293

[22] PCT Filed: Sep. 12, 1990

[86] PCT No.: PCT/EP90/01539

§ 371 Date: Mar. 13, 1992

§ 102(e) Date: Mar. 13, 1992

[87] PCT Pub. No.: WO91/04514

PCT Pub. Date: Apr. 4, 1991

[30] Foreign Application Priority Data

Sep. 14, 1989 [DE] Fed. Rep. of Germany ..... 3930667

[51] Int. Cl.[5] ..... G03G 5/024; G03G 5/12; G03G 15/056

[52] U.S. Cl. ..... 430/19; 430/20; 430/51; 430/945; 430/97; 430/124; 430/126; 430/42; 355/211; 365/108; 359/43; 359/45

[58] Field of Search ..... 430/19, 20, 42, 51, 430/945, 126, 97, 124; 359/43, 45; 355/211; 365/108

[56] References Cited

U.S. PATENT DOCUMENTS 3,575,500 4/1971 Schlein et al. ..... 355/3
3,671,231 6/1972 Haas et al. ..... 430/19

(List continued on next page.)

FOREIGN PATENT DOCUMENTS 205187 12/1986 European Pat. Off. .
226218 6/1987 European Pat. Off. .
228703 7/1987 European Pat. Off. .
0246500 11/1987 European Pat. Off. .
258898 3/1988 European Pat. Off. .

(List continued on next page.)

OTHER PUBLICATIONS

Research Disclosure 31660, Aug. 1990, "Rewritable Xeroprinting Master".

*Primary Examiner*—Charles L. Bowers, Jr.
*Assistant Examiner*—John A. McPherson
*Attorney, Agent, or Firm*—Keil & Weinkauf

[57] ABSTRACT

A process for the reversible or irreversible production of an image by imagewise exposure of a recording layer to energy in the presence or absence of an electrical and/or magnetic field, resulting in a pattern of surface charges on the surface of the recording layer corresponding to the imagewise exposure to energy. The recording layer consists essentially of an organic material which solidifies in a glass-like manner, is non-photoconductive or substantially non-photoconductive and contains permanent dipoles, in which the pattern of surface charges is produced without or substantially without the formation of free charge carriers by reversible imagewise alignment of at least some of the permanent dipoles present in the recording layer.

The process is advantageously carried out using an apparatus which comprises a suitable recording element, devices for imagewise exposure of the recording layer of the recording element to energy, and a counter-electrode which is in direct contact with the recording layer and can be removed therefrom. The pattern of surface charges produced by the process can be toned with liquid or solid toners. The resultant toner image can then either be fixed on the recording layer or transferred from the recording layer to another surface, after which the pattern of surface charges can be erased by exposing the entire surface to energy. A further image can then be produced. In this way, photocopies can be produced without the need to use the high-voltage sources which are necessary in conventional electrophotographic processes.

31 Claims, No Drawings

U.S. PATENT DOCUMENTS

| | | | |
|---|---|---|---|
| 3,804,618 | 4/1974 | Forest et al. | 430/20 |
| 3,972,588 | 8/1976 | Adams et al. | 359/72 |
| 4,661,576 | 4/1987 | Decobert et al. | 526/298 |
| 4,752,820 | 6/1988 | Kuroiwa et al. | 365/108 |
| 4,762,912 | 8/1988 | Leslie et al. | 528/503 |
| 4,837,745 | 6/1989 | Eich et al. | 365/108 |
| 4,896,292 | 1/1990 | Eich et al. | 365/108 |
| 5,038,166 | 8/1991 | Isaka et al. | 355/27 |
| 5,172,164 | 12/1992 | Fujiwara et al. | 355/212 |

FOREIGN PATENT DOCUMENTS

| | | |
|---|---|---|
| 271900 | 6/1988 | European Pat. Off. . |
| 274128 | 7/1988 | European Pat. Off. . |
| 141512 | 7/1989 | European Pat. Off. . |
| 0385329 | 9/1990 | European Pat. Off. . |
| WO86/02937 | 5/1986 | PCT Int'l Appl. . |
| WO87/07890 | 12/1987 | PCT Int'l Appl. . |
| 1235553 | 6/1971 | United Kingdom . |
| 2181263 | 4/1987 | United Kingdom . |

REVERSIBLE OR IRREVERSIBLE PRODUCTION OF AN IMAGE

The present invention relates to a novel process for the reversible or irreversible production of an image by imagewise exposure of a recording layer to energy in the presence or absence of an electrical and/or magnetic field, resulting in a pattern of surface charges on the surface of the recording layer corresponding to the imagewise exposure to energy.

Processes of this type in which patterns of surface charges can be produced in a variety of ways utilizing various physical mechanisms are known. Specific examples are xerography or electrophotography, in which a photoconductive recording layer is provided with a positive or negative electrical charge, for example by means of a high-tension corona discharge, and the electrically charged recording layer is then exposed imagewise to actinic light. The exposure causes the photoconductive recording layer to become electroconducting in its exposed areas, and the previously produced electrostatic charge in these areas can thus dissipate via an electroconductive substrate. A latent electrostatic image is thus produced on the photoconductive recording layer and can be developed using suitable liquid or solid toners to give a visible image. This toner image can then be transferred in a conventional manner from the recording layer to another surface, resulting in a photocopy. Alternatively, the toner image can be fixed on the photoconductive recording layer, for example by heating, and the exposed and therefore toner-free areas of the photoconductive recording layer can then be washed out using suitable liquid developer solvents. The resultant relief layer can then be used, for example, for printing. The physical process on which this imagewise information-recording technique is based is also known in the scientific literature as the Carlson process. In summary, xerography involves the formation of the pattern of surface charges by the production and imagewise removal of free charge carriers.

As is known, xerography has disadvantages. For example, generation of the high-voltage corona discharge for charging the surface of the photoconductive recording layer requires direct voltages of the order of from 6 kV to 10 kV, which causes problems from a safety and, due to the formation of ozone, toxicological point of view. In addition, since the pattern of surface charges is formed from free electrical charges, the success of the process is impaired by the presence of water. This means that excessive atmospheric moisture causes premature dissipation of the surface charges, even in the dark, or prevents sufficient charging of the surface of the photoconductive recording layer. Moreover, it is not possible in xerography to produce more than one copy from a single exposure.

A modified xerographic process which overcomes these disadvantages to a certain extent is disclosed in DE-A-15 22 688. In this process, the pattern of surface charges is produced by exposing the entire surface of a suitable photoconductive recording layer to light in the presence of an electrical field having a field strength of from 1000 V/cm to 15,000 V/cm, producing a uniform internal electrical polarization in the recording layer. The pattern of surface charges is then formed by local destruction or modification of the internal polarization. Unlike xerography, the pattern of surface charges is thus in the narrower sense a residual electrical polarization image comprising either positively or negatively electrically charged areas and uncharged areas or comprising positively and negatively electrically charged areas. This residual electrical polarization image can be toned in a conventional manner using liquid or solid toners, it being possible to simultaneously tone the residual electrical polarization image composed of negatively and positively electrically charged areas using two toners of opposite electrical charge and different color.

Even this known process still has numerous disadvantages. For example, the photoconductive recording layer used is a relatively thick (15 to 55 μm) inhomogeneous layer of a photoconductive pigment embedded in an electroinsulating matrix. The latter, which is essential for the known process, makes it impossible to reduce the thickness of the recording layer. In addition, a very high voltage must still be applied to the photoconductive recording layer to ensure the success of the process, the reversible production of an image. Moreover, it is advisable to screen polarized photoconductive recording layer against undesired exposure to light which, in general, increases the equipment costs. Since the known process is again based on the production of free charge carriers, the polarized photoconductive recording layer is still sensitive to atmospheric moisture, and the electrical charges may be neutralized at elevated temperature, which in the end results in an unstable image. Furthermore, charge images, which are composed of areas of opposite polarization, ie. negatively and positively electrically charged areas, can only be formed using a further non-removable electrode in direct contact with the photoconductive recording layer. This further electrode frequently reduces the adhesion of the toner to the correspondingly charged areas of the pattern, which drastically impairs the quality of the photocopies. Finally, the known process and the photoconductive recording layer used therein are not suitable for the reversible production of an image by imagewise warming of a recording layer using a thermal printing head or using laser light emitted by a semiconductor laser.

EP-A-0 246 500 relates to a layered element having a layer base with a hydrophobic surface and at least one solid, thin, ordered layer, applied thereto, of a defined, uniform and regular structure with a uniform molecular orientation in one direction of a metallo-macrocyclic polymer, which is soluble in an organic, water-immiscible solvent and/or is fusible, and to the use thereof in electrophotography.

It is an object of the present invention to provide a novel process for the reversible or irreversible production of an image in which imagewise exposure of a recording layer to energy in the presence or absence of an electric and/or magnetic field results in a pattern of surface charges on the surface of the recording layer corresponding to the imagewise exposure to energy, and which no longer has the disadvantages of the prior art.

It is a further object of the present invention to provide a novel process for the production of two-color photocopies in which a residual electrical polarization image composed of positively and negatively electrically charged areas is produced on the surface of a recording layer, and which again no longer has the disadvantages of the prior art.

Finally, it is a further object of the present invention to provide a novel machine using which the novel process for the reversible or irreversible production of an image and the novel process for the production of two-color photocopies can be carried out particularly simply and efficiently.

We have found that, surprisingly, this object can be achieved by means of

- a novel process for the reversible or irreversible production of an image by imagewise exposure of a recording layer (a) to energy in the presence or absence of an electrical and/or magnetic field, resulting in a pattern of surface charges on the surface of the recording layer (a) corresponding to the imagewise exposure to energy,
- a novel process for the production of two- or multicolor photocopies by producing a residual electrical polarization image composed of positively and negatively electrically charged areas or containing such areas, on the surface of a recording layer (a), and
- a novel machine for the reversible or irreversible production of an image, the novel processes and the novel machine using a recording layer (a) in which the pattern of surface charges or the residual electrical polarization image can be produced without or virtually without the formation of free charge carriers and without the use of high electrical voltages by reversible imagewise alignment or by reversible imagewise destruction of the alignment of permanent dipoles.

Surprisingly, this solution involves layers which have nematic liquid-crystalline, smectic liquid-crystalline or enantiotropic, ferroelectric smectic liquid-crystalline ($S_c^*$) behavior, and are thus, at a sufficiently high temperature and on application of an external electrical field, either converted into a polarized nematic liquid-crystalline ordered state and can be frozen in this state in a glass-like manner on the cooling, or can be switched back and forth between two thermodynamically stable, ferroelectric, smectic liquid-crystalline $S_c^*$ ordered states.

The present invention accordingly provides a novel process for the reversible or irreversible production of an image by imagewise exposure of a recording layer (a) to energy in the presence or absence of an electrical and/or magnetic field, resulting in a pattern of surface charges on the surface of the recording layer (a) corresponding to the imagewise exposure to energy, wherein (1) the recording layer (a) contains or comprises an organic material which has a nematic liquid-crystalline, smectic liquid-crystalline or ferroelectric smectic liquid-crystalline behavior which solidifies in a glass-like manner, is not or only slightly photoconductive and contains permanent dipoles, and wherein (2) the pattern of surface charges is produced therein without or virtually without formation of free charge carriers by reversible imagewise alignment of all or some of the permanent dipoles present in the recording layer (a), the energy used for imagewise exposure being thermal.

The present invention furthermore provides a novel machine using which the novel process can be carried out in a particularly simple and efficient manner.

In view of the prior art, it could not have been expected that it would have been possible to achieve the object of the invention by the novel process and by the novel machine. It is furthermore surprising that the novel process has so many advantageous possible embodiments and that the novel machine also has so many possible applications.

The novel process for the reversible or irreversible production of an image by imagewise exposure of a recording layer (a) to energy in the presence or absence of an electrical and/or magnetic field, resulting in a pattern of surface charges on the surface of the recording layer (a) corresponding to the imagewise exposure to energy is for brevity abbreviated hereinafter to the process according to the invention.

For the same reason, the novel machine used for the reversible or irreversible production of an image by imagewise exposure of a recording layer (a) to energy in the presence or absence of an electrical and/or magnetic field, resulting in a pattern of surface charges on the surface of the recording layer (a) corresponding to the imagewise exposure to energy is abbreviated to the machine according to the invention.

The process according to the invention is practiced using the recording layer (a).

The invention can be carried out using any recording layer (a) which contains or comprises an organic material which solidifies in a glass-like manner, is not or only slightly photoconductive and contains permanent dipoles; particularly suitable and therefore preferred recording layers (a) are those which comprise only an organic material of this type.

Accordingly, recording layers (a) which are suitable and highly suitable for use according to the invention can be prepared using any organic material which solidifies in a glass-like manner, is not or only slightly photoconductive and contains permanent dipoles and in which no or only very few free charge carriers can be produced by exposure due to the absence or low level of photoconductivity.

The organic materials which are suitable for use according to the invention may be low-molecular-weight, oligomeric or high-molecular-weight compounds; the latter may also incorporate two-dimensional or three-dimensional crosslinking. Of these, the high-molecular-weight compounds are particularly preferred for the purposes of the invention.

Examples of highly suitable organic materials which can be used according to the invention are those having a nematic liquid-crystalline, smectic liquid-crystalline or ferroelectric smectic liquid-crystalline behavior. Of these, those having a nematic liquid-crystalline or ferroelectric smectic liquid-crystalline behavior are particularly preferred and those having a ferroelectric smectic liquid-crystalline behavior are very particularly preferred.

The nematic liquid-crystalline compounds particularly preferably used for the purposes of the invention contain permanent dipoles which do not usually align causing a macroscopic dipole moment. However, their permanent dipoles can be aligned preferentially in the field direction at appropriate temperatures by applying an electrical field. After the organic material in question has cooled to below its glass transition temperature $T_G$, the alignment of the permanent dipoles is frozen in a glass-like manner, resulting in a macroscopic dipole moment (cf. U.S. Pat. No. 4,762,912).

Examples of highly suitable nematic liquid-crystalline compounds which are particularly preferred for the purposes of the invention are disclosed in U.S. Pat. No. 4,762,912, EP-A-0 007 574, EP-A-0 141 512 and EP-A-0 171 045.

Of the ferroelectric smectic liquid-crystalline compounds which are very particularly preferred for the purposes of the invention, particular mention should be made of those which have an enantiotropic, ferroelectric smectic liquid-crystalline ($S_c^*$) behavior in thin layers and can therefore be switched back and forth between two thermodynamically stable, ferroelectric smectic liquid-crystalline $S_c^*$ ordered states at sufficiently high temperature by applying an external electrical field. As is known, this type of behavior is exhibited by chiral mesogenic compounds or groups which contain at least one optically active center. These compounds or groups are able to form a smectic liquid-crystalline phase, in which the chiral mesogenic compounds or groups are overall aligned parallel due to intermolecular interactions and are assembled to form microlayers stacked one on top of the other at equal distances. These $S_c^*$ phases have a spontaneous electrical polarization even in the absence of an external electrical field. This residual polarization can be reoriented by applying an external electrical field; for this reason, the phases are, logically, known as ferroelectric.

The ferroelectric, smectic liquid-crystalline $S_c^*$ phase has the microlayer structure which is generally typical of smectic liquid-crystalline phases, with the longitudinal molecular axes of the chiral mesogenic compounds having a tilt angle $\theta$ of $+\alpha$ or $-\alpha$ to the layer perpendiculars Z in the individual microlayers. The tilt direction or angle $\theta$ of the longitudinal molecular axes in a microlayer relative to the layer perpendiculars Z is generally given by the director $\vec{n}$. Overall, the alignment of the individual lateral dipoles of the chiral mesogenic compounds or groups results in a macroscopic dipole moment. However, the director $\vec{n}$ in the $S_c^*$ phase generally results, unless spatially restricted, in a precession around the perpendiculars Z on passing through the individual microlayer planes, ie. the polarization vector $\vec{P}$ which gives the direction of the total dipole moment of the phase, passes through the $S_c^*$ phase on a helix, resulting in a total dipole moment of 0.

If, however, a ferroelectric smectic liquid-crystalline $S_c^*$ phase is of limited thickness and is warmed in an external electrical field of suitable sign and suitable alignment or subjected to a very strong external electrical field of suitable sign and suitable alignment, the direction of polarization in the $S_c^*$ phase can be reversed when a threshold field strength which depends on the particular chiral mesogenic compound used is exceeded, so that its polarization vector $\vec{P}$ again agrees with the external electrical field. This reversal of the polarization is based on the "flipping over" of the longitudinal molecular axes of the chiral mesogenic compounds or groups from the tilt angle $\theta$ of $+\alpha$ to $-\alpha$ or vice versa, during which a new ferroelectric smectic liquid-crystalline $S_c^*$ ordered state forms in the phase. If these two ferroelectric smectic liquid-crystalline $S_c^*$ ordered states are thermodynamically stable, we speak of enantiotropic, ferroelectric, smectic liquid-crystalline $S_c^*$ behavior. Since the longitudinal molecular axes of the chiral mesogenic compounds or groups flip over on a conical track, the change between these two $S_c^*$ ordered states is completed very rapidly; for this reason, the switching times $\tau$ for the switching back and forth of the $S_c^*$ phase between these two $S_c^*$ ordered states are extremely short.

As is known, this behavior is particularly pronounced if the chiral mesogenic compounds are in a layer whose thickness d is less than the pitch G of the helix along which the director $\vec{n}$ undergoes its precession motion through the $S_c^*$ phase. In a macroscopic layer of this type, the helix described by the precession motion of the director $\vec{n}$ is wound-up spontaneously, which means that the chiral mesogenic compounds or groups have only two possible alignments.

Of very particular advantage here are chiral mesogenic compounds and groups to be used according to the invention in which, after local warming and cooling in the presence of an electrical field, one of the two thermodynamically stable (enantiotropic), ferroelectric smectic liquid-crystalline $S_c^*$ ordered states can be frozen locally in a glass-like manner at room temperature, the chiral mesogenic compounds or groups in question in the other non-warmed areas of the organic material being either in the other thermodynamically stable, ferroelectric smectic liquid-crystalline $S_c^*$ ordered state, in another liquid-crystalline phase, which is not necessarily ferroelectric, in unordered microdomaines (centers of scattering) or in an isotropic I phase. It is of very particular advantage according to the invention for the chiral mesogenic compounds or groups to be in the other thermodynamically stable, ferroelectric smectic liquid-crystalline $S_c^*$ ordered state.

There is an additional advantage for the recording layer (a) if the chiral mesogenic compounds or groups it contains undergo a transition into the isotropic I phase below 200° C., ie. have a clear point of less than 200° C.

Furthermore, an additional advantage arises for the recording layer (a) to be used according to the invention if the chiral mesogenic compounds or groups it contains have an $S_c^* \rightarrow S_A^*$ phase transition, generally also known as the Curie temperature $T_c$, in the range from 50° to 150° C., preferably from 50° to 100° C., in particular from 50° to 90° C.

It is furthermore of very particular advantage for the recording layer (a) to be used according to the invention if the organic materials it contains which have permanent dipoles have a glass transition temperature $T_g$ above 25° C.

Examples of compounds having an enantiotropic, ferroelectric smectic liquid-crystalline ($S_c^*$) behavior which are particularly suitable for the purposes of the invention are disclosed in EP-A-0 184 482, EP-A-0 228 703, EP-A-0 258 898, EP-A-0 231 858, EP-A-0 231 857, EP-A-0 271 900 or EP-A-0 274 128 or are described in German Patent Application P 39 17 196.5.

Accordingly, the recording layers (a) which comprise or contain chiral mesogenic compounds or groups, respectively, of the abovementioned type have very particular advantages when used according to the invention and are therefore particularly suitable for the process according to the invention.

In the highly suitable recording layers (a) according to the invention, the microlayer planes of the $S_c^*$ phase formed by the chiral mesogenic compounds or groups are aligned perpendicular to the plane of the recording layer (a). In general, the highly suitable recording layers (a) to be used according to the invention have a ferroelectric spontaneous polarization $P_s$ or a dipole density or a sum of aligned dipole moments per unit volume of the recording layer (a) used in each case of from 1 to 300 nC/cm$^2$ advantageously from 10 to. 300 nC/cm$^2$, in particular from 20 to 300 nC/cm$^2$.

In general, the very highly suitable recording layer (a) to be used according to the invention has a thickness d of from 0.1 to 20 $\mu$m. If it is more than 20 $\mu$m thick, a loss of bistability may occur under certain circumstances, while a thickness d of less than 0.1 μm may result in deformation, for example due to capillary effects. The thickness range of from 0.1 to 20 μm is thus an optimum within which the thickness d of the recording layer (a) varies greatly and can be matched to the particular requirements presented on the one hand by the applicational property profile desired in each case and on the other hand by the physical chemical properties of the organic materials used in each case. Within the thickness range, that from 0.1 to 10 μm, advantageously from 0.1 to 8 μm, in particular from 0.2 to 5 μm, is particularly re-emphasized since the excellent recording layers (a) of this thickness range have very particular advantages when the process according to the invention is carried out, in particular higher sensitivity to imagewise exposure to energy and better stability of the residual electrical polarization image.

The method of preparation of the recording layers (a) to be used according to the invention has no peculiarities; the recording layers are instead produced from the above-described conventional and known organic materials, some of which are commercially available, but in particular from low-molecular-weight chiral mesogenic compounds having an enantiotropic, ferroelectric smectic liquid-crystalline ($S_c^*$) behavior or from crosslinked or uncrosslinked polymers containing chiral mesogenic side groups having enantiotropic, ferroelectric smectic liquid-crystalline ($S_c^*$) behavior, by conventional and known techniques for the production of thin layers.

Examples of suitable techniques for the production of thin layers from low-molecular-weight chiral mesogenic compounds of the abovementioned type and the particular compounds themselves are disclosed, for example, in U.S. Pat. No. 4 752 820, WO-A-87/07890 and WO-A TM 86/02937.

Furthermore, EP-A-0 184 482, EP-A-0 228 703, EP-A-0 258 898, EP-A-0 231 858, EP-A-0 231 857, EP-A-0 271 900 or EP-A-0 274 128 disclose the techniques for the production of thin layers from crosslinked or uncrosslinked polymers containing chiral mesogenic side groups of the abovementioned type and the particular polymers themselves or they are described in detail, for example, in German Patent Application P 39 17 196.5. The techniques mentioned therein for the production of thin layers and the polymers used in these techniques are particularly preferably employed for the production of the recording layers (a) to be used according to the invention.

In order to carry out the process according to the invention, the recording layer (a) to be used according to the invention is applied in the desired, suitable thickness in a conventional and known manner to the alignment layer (e) of an electroconductive substrate (b) which contains at least one dimensionally stable carrier layer (c), an electrode layer (d) and an alignment layer (e) in the stated sequence one on top of the other, resulting in a recording element (A, D, E) which contains at least said layers (c), (d), (e) and (a) in the stated sequence one on top of the other.

Examples of dimensionally stable carrier layers (c), electrode layers (d) and alignment layers (e) which are suitable for construction of the recording element (A, D, E) to be used in the process according to the invention are disclosed in the patent publications WO-A-86/02937, WO-A-87/07890, U.S. Pat. No. 4,752,820, GB-A-2,181,263, U.S. Pat. No. 4,752,820, EP-A-0 184 482, EP-A-0 205 187, EP-A-0 226 218, EP-A-0 228 703, EP-A-0 231 857, EP-A-0 231 858, EP-A-0 258 898, EP-A-0 271 900 and EP-A-0 274 128, or are described in German Patent Application P 39 17 196.5.

When carrying out the process according to the invention, imagewise exposure of the surface of the recording layer (a) to energy in the presence or absence of an electrical and/or magnetic field produces a pattern of surface charges corresponding to the imagewise exposure to energy, ie. a residual electrical polarization image, which is composed of or contains positively and negatively electrically charged areas or positively or negatively electrically charged areas and uncharged areas.

According to the invention, this pattern of surface charges or the residual electrical polarization image is produced without or virtually without the formation of free charge carriers by the reversible imagewise alignment of all or some of the permanent dipoles present in the recording layer (a).

According to the invention, this can take place (i) in the absence of an electrical and/or magnetic field by reversible imagewise destruction of the alignment of some of the aligned permanent dipoles present in the recording layer (a), (ii) in the presence of an electrical and/or magnetic field by reversible imagewise modification or reversal of the alignment of some of the aligned permanent dipoles present in the recording layer (a), or (iii) in the presence of an electrical field by reversible imagewise alignment of some of the non-aligned permanent dipoles present in the recording layer (a), on imagewise exposure of the recording layer (a) to energy.

The imagewise exposure to thermal energy is advantageous according to the invention, the use of laser light, in particular that emitted by semiconductor lasers, or of a conventional and known thermal printing head being of particular advantage.

If laser light is used, it is advisable for the recording layer (a) to contain conventional and known components which may be chemically bonded to the organic material in question and which strongly absorb the laser light, and/or for the recording layer (a) to be on a conventional and known layer which strongly absorbs the laser light.

The pattern of surface charges or the residual electrical polarization image resulting in the procedure according to the invention can be erased again, after its use according to the invention, either by exposing the entire surface to energy in the presence or absence of an electrical and/or magnetic field without the formation of free charge carriers with alignment of all the permanent dipoles present over the entire surface of the recording layer (a) or with destruction over the entire surface of the alignment of the permanent dipoles present in each case in the individual areas of the pattern or of the image. Thermal energy is again advantageous according to the invention.

After the erasure, a new pattern of surface charges or a residual electrical polarization image can, according to the invention be produced in the recording layer (a); the process according to the invention is thus reversible.

An example of a preferred use of the pattern of surface charges or of the residual electrical polarization image according to the invention is toning thereof with liquid or solid toners, after which the resultant toner image can be transferred to another surface, giving a photocopy of the pattern or image thereon.

According to the invention, the toning can then be repeated, ie. more than one photocopy can be obtained from one pattern of surface charges or from one residual electrical polarization image, which is a very particular advantage of the process according to the invention. The pattern or image present in the recording layer (a) can be erased again in the abovementioned manner, after which a new pattern or image can be produced in the manner according to the invention and, after re-toning, used for copying purposes.

In addition, the residual electrical polarization image produced in the manner according to the invention, which is composed of or contains positively or negatively electrically charged areas, can according to the invention be simultaneously or successively toned with at least two liquid or solid toners of opposite electrical charge, giving a two- or multicolor toner image which, when transferred from the recording layer (a) to another surface, gives a two- or multicolor photocopy. Further advantages arise if at least two toners are used here which are optically very contrasting. It is also possible according to the invention to obtain more than one photocopy from one and the same residual electrical polarization image.

It is also possible to tone the pattern of surface charges or the residual electrical polarization image produced in the manner according to the invention using at least one liquid or solid toner, and then to fix the resultant toner image, for example by heating. It goes without saying that this fixed toner image produced by the procedure according to the invention can no longer be erased, and this embodiment of the process according to the invention is thus irreversible. However, this is balanced by the fact that the untoned areas of the fixed toner image can be washed out using a suitable developer solvent, giving a relief layer on the recording element which can be used, inter alia, for printing purposes.

The process according to the invention may be carried out using a variety of equipment.

However, it is advantageous according to the invention to use the machine according to the invention to carry out the process according to the invention.

The machine according to the invention comprises at least one of the recording elements (A, D, E) described above in detail, at least one counterelectrode (C, F), and at least one energy source or device (B) for image-wise exposure of the recording layer (a) to energy.

It is advantageous according to the invention for the device (B) for imagewise exposure to energy to contain a laser light source (G), in particular a semiconductor laser, or a conventional and known thermal printing head (G).

It is also advantageous according to the invention for the counterelectrode (C, F) to be arranged in such a manner that it can be removed again from the recording element (A, D, E). The counterelectrode (C, F) is preferably in direct contact with the recording layer (a, D). It may be in the form of a planar or curved plate or in the form of a roller which is moved over the recording element (A, D, E) in apparent motion at a suitable speed. The counterelectrode (C, F) is connected opposite the electrode layer (d) of the electroconductive substrate (b). The surface of the counterelectrode (C, F) may be covered by a conventional and known polysiloxane layer or teflon layer (h).

It is furthermore advantageous according to the invention for the surface of the counterelectrode (C, F) either to be structured in such a manner that it acts as an alignment layer (g) or to be covered by an alignment layer (g) which either corresponds in composition and structure to the alignment layer (e) of the recording element (A, D, E) or differs therefrom. Furthermore, the counterelectrode (C, F) may be heated and/or has a relief-like surface.

The machine according to the invention may contain a planar or roller-shaped recording element (A, D, E).

If the machine according to the invention contains a planar recording element (A, D, E), either the planar or the curved plate-like counterelectrode may be printed onto the recording layer (a) of the recording element (A, D, E), the entire surface of the recording layer (a) or only part thereof being covered by the counterelectrode (C, F). Alternatively, the roller-shaped electrode (C, F) may be used, which is then passed in apparent motion over its recording layer (a) at a suitable speed, preferably over the full width of the recording element (A, D, E).

If, by contrast, the machine according to the invention contains a roller-shaped recording element (A, D, E), then either the planar or the curved plate-shaped counterelectrode (C, F) can be used, over which the roller-shaped recording element (A, D, E) is passed in apparent motion at a suitable speed. It is also possible to use the roller-shaped counterelectrode (C, F), which is rotated against the roller-shaped recording element (A, D, E) at a suitable speed in the manner of a calander, which is of very particular advantage according to the invention.

Furthermore, the machine according to the invention can contain at least one device (H) for toning the pattern of surface charges produced in the recording layer (a) with solid or liquid toners, at least one device (I) for transferring the toner image from the recording layer (a) to another surface, or alternatively at least one device (J) for fixing the toner image, at least one device (K) for exposing the entire surface of the recording element (A, D, E) to energy, in particular thermal energy, which device may also be contained in the counterelectrode (C, F), and at least one device (L) for producing electrical and/or magnetic fields which are able to pass through the recording element (A, D, E) over the entire surface.

In addition, the machine according to the invention contains conventional and known electrical and/or mechanical devices used to control the machine according to the invention such as electrical and/or mechanical control systems and servomotors. In addition, the machine according to the invention may be connected to and controlled by a process computer.

The process according to the invention using the machine according to the invention can be carried out in principle in five ways, which are explained in illustrative manner below:

1. in the range from 1 to 100 V is applied between the roller-shaped counterelectrode (C, F) and the electrode layer (d) of the recording element (A, D, E). The roller-shaped counter electrode (C, F) is then passed in apparent motion over the recording layer (a) of the recording element (A, D, E) at a suitable speed. The permanent dipoles present in the recording layer (a) are thereby aligned over the entire surface The moving roller-shaped counterelectrode (C, F) is followed immediately by imagewise exposure to energy, resulting in the pattern of surface charges or the residual electrical polarization image. The recording element (A, D, E), which now contains the pattern or the image, is then passed in apparent motion at a speed matched to the movement of the roller-shaped counterelectrode (C, F) to the toner device (H), where it is toned. The toned recording element (A, D, E) is then passed in apparent motion at the matched speed to the device (I) for transferring the toner image from the recording layer (a) to another surface. Thereafter, either the toner-free recording element can be passed back to the toner device (H) and to the device (I) for transferring the toner image, and two or more copies of the original pattern or image can be produced, or the roller-shaped electrode (C, E) can again be moved over the recording element (A, D, E) in matched apparent motion in order to erase the pattern or image.

2. Instead of being passed to a device (I) for transferring the toner image from the recording layer (a) to the other surface, the toned recording element (A, D, E) can be moved to a device (J) for fixing the toner image, and the recording element (A, D, E) then leaves the machine according to the invention for further processing in a suitable way.

3. An electrical field aligned perpendicular to the recording layer (a) is applied to the recording element (A, D, E) having a recording layer (a) which is not aligned over the entire surface. The recording layer (a) is then warmed imagewise, producing the pattern of surface charges or the residual electrical polarization image. The recording element (A, D, E) is then passed in apparent motion at a suitable speed as described under section 1. to the devices for toning (H) and transferring the toner image from the recording layer (a) to another surface (I) or alternatively to a device (J) for fixing the toner image. If the pattern or image present in the recording layer (a) is to be erased again, the recording layer (a) is heated sufficiently for the imagewise alignment of the permanent dipoles in the recording layer (a) to be destroyed again.

4. This embodiment is carried out as described under section 1, but, to produce a residual electrical polarization image composed of positively and negatively electrically charged areas, an electrical field whose field lines pass through the recording layer (a) is applied over the entire surface during the imagewise exposure of the recording layer (a) to energy, and the residual electrical polarization image is advantageously toned successively in the toner device (H) with two optically highly contrasting toners of opposite electrical charge, which gives a two-color toner image. This is used in the same way as described for the embodiment under section 1. for the production of photocopies; however, the latter are now two-colored.

5. In this embodiment, a suitable voltage in the range from 1 to 100 V is applied between the roller-shaped counterelectrode (C, F) and the electrode layer (d) of the recording element (A, D, E). The roller-shaped counterelectrode (C, F) is then passed over the recording layer (a) of the recording element (A, D, E) in apparent motion at a suitable speed. Unlike the embodiment described under section 1., the temperature and field strength here are selected so that the recording layer (a) is not aligned over the entire surface. The moving roller-shaped counterelectrode (C, F) is immediately followed by the imagewise exposure to energy, giving a first pattern of surface charges or a first residual electrical polarization image. This imaging process or step is then repeated, but with the voltage between the roller-shaped counterelectrode (C, F) and the electrode layer (d) being reversed, and a second residual electrical polarization image which is different from the first polarization image and has opposite electrical surface charges is formed. The recording element (A, D, E), whose recording layer (a) contains electrically positive and negative areas, is subsequently used in the same manner as described for the embodiment under section 4., for the production of two-color photocopies.

The process according to the invention has numerous particular advantages: it can be carried out without using very high voltages, and thus eliminates numerous safety problems. Since no or very few charge carriers are produced when it is carried out, it is insensitive to atmospheric moisture and heat. Light screening is not necessary, and the process can be carried out using homogenous thin recording layers, which are highly suitable for imagewise warming using laser light, in particular using light emitted by semiconductor lasers, or using a thermal printing head. Moreover, both the process according to the invention and the machine according to the invention are extremely flexible, and can thus be used with advantage in a wide variety of embodiments.

EXAMPLES

Example 1

Reversible Production of an Image Using the Process According to the Invention

Experimental Procedure

To carry out the process according to the invention, first a recording element is produced from a glass plate as the dimensionally stable carrier layer, a 0.7 μm thick, conductive, transparent electrode layer comprising indium/tin oxide (ITO), a rubbed polyimide layer produced in a conventional and known manner by spin-coating a 3% strength solution of a polyimide precursor (Liquicoat® ZLI 2650 from Merck AG), drying the resultant wet layer, baking the polyimide precursor layer at 300° C. for four hours and rubbing the resultant polyimide layer with a velour cloth, and a 1.2 μm thick recording layer of the polymer which has enantiotropic ferroelectric smectic liquid-Crystalline properties and has the following $^1H$ nuclear magnetic resonance spectrum (δ in ppm; tetramethylsilane as internal standard): 1.00–2.80 (multiplet m, al-H) 3.80–4.15 (m, 4H, $OCH_2$) 5.28–5.36 (m, 1, OCH) 6.95–8.27 (m, 12 ar-H).

This polymer was applied to the polyimide layer by knife coating a 10% strength solution thereof in tetrachloroethane in such a manner that the recording layer having the abovementioned thickness remained after drying.

After application in the above-described manner, the recording layer was warmed briefly to above 160° C., after which the recording layer was in the form of an isotropic melt.

After cooling to room temperature, the recording layer had a polydomane structure with a homogeneous planar alignment over the entire surface. The homogeneous planar alignment means that the microlayer planes of the smectic layers in the material of the recording layer are all perpendicular to the plane of the recording element.

The recording layer with a homogoneous planar alignment was then brought into direct contact, without being deformed, with an ITO electrode layer (image electrode) which had been etched imagewise and had been produced in a conventional and known manner by imagewise etching of an ITO electrode over the entire surface on a glass plate and coating the resultant electrode image relief with a thin Teflon layer with antiadhesive properties. A direct voltage of 50 volts was then applied between the image electrode and the electrode layer of the recording element, and the recording layer was at the same time briefly heated to 120° C. The simultaneous action of heat and electrical field polarized the recording layer at the points at which it was in contact with the image electrode. The recording layer was then rapidly cooled to room temperature, and the image electrode was removed from the recording layer.

This procedure resulted, in the recording layer, in a polarization image, which was toned using a conventional and known electrophotographic developer. The toner adhered to the points of the recording layer which had previously been in direct contact with the image electrode and had thereby been polarized. The overall result was a positive toner image of the electrode image relief; this was easily transferable to another surface, for example paper. It was subsequently possible to repeat the imaging process a number of times in the manner according to the invention without any loss in imaging quality occurring.

Example 2

Reversible Production of an Image Using the Process According to the Invention

Procedure

The recording element of Example 1 was brought into direct contact over the entire surface with a flat teflon-coated metal electrode (counterelectrode). It was again ensured that the recording layer of the recording element was not deformed during the direct contact. After application of a direct voltage of 50 volts between the counterelectrode and the electrode layer of the recording element, the recording layer was heated to 120° C. and thus polarized over the entire surface. The recording layer was cooled to room temperature, and the counterelectrode was removed.

Imagewise information was then written into the recording layer, polarized over the entire surface, of the recording element using a commercially available thermal printing head, as usually used for thermal transfer printing. The points of the recording layer, polarized over the entire surface, which came into brief contact with the thermal printing head were depolarized, giving a negative polarization image of the image information transferred by means of the thermal printing head. This toner image could likewise be toned using a conventional and known electrophotographic developer; the toner image obtained on the recording element was then easily transferable to paper.

After the transfer, the recording element was available for further imaging cycles.

We claim:

1. A process for the reversible or irreversible production of an image by imagewise exposure of a recording layer (a) to energy in the presence or absence of an electrical and/or magnetic field, resulting in a pattern of surface charges on the surface of the recording layer (a) corresponding to the imagewise exposure to energy, wherein (1) the recording layer (a) comprises an organic material which has a nematic liquid-crystalline, smectic liquid-crystalline or ferroelectric smectic liquid-crystalline behavior which solidifies in a glass-like manner, is not or only slightly photoconductive and contains permanent dipoles, and wherein (2) the pattern of surface charges is produced therein without or virtually without formation of free charge carriers by reversible imagewise alignment of all or some of the permanent dipoles present in the recording layer (a), the energy used for imagewise exposure being thermal.

2. A process as claimed in claim 1, wherein the pattern of surface charges is produced without or virtually without the formation of free charge carriers by reversible imagewise destruction of the alignment of some of the aligned permanent dipoles present in the recording layer (a).

3. A process as claimed in claim 1, wherein the pattern of surface charges is produced without or virtually without the formation of free charge carriers in the presence of an electrical and/or magnetic field by reversible imagewise modification or reversal of the alignment of some of the uniformly aligned permanent dipoles present in the recording layer (a).

4. A process as claimed in claim 1, wherein the pattern of surface charges is produced without or virtually without the formation of free charge carriers in the presence of an electrical and/or magnetic field by reversible imagewise alignment of some of the non-aligned permanent dipoles present in the recording layer (a).

5. A process as claimed in claim 1 wherein the energy source used is a laser light source or a thermal printing head.

6. A process as claimed in claim 5, wherein the recording layer (a) contains components which strongly absorb the laser light, and/or wherein the recording layer (a) is on a layer which strongly absorbs the laser light.

7. A process as claimed in claim 1 wherein the pattern of surface charges present on the recording layer (a) is erased again, after its use according to the invention, by exposing the entire surface to energy in the presence or absence of an electrical and/or magnetic field without the formation of free charge carriers either with alignment of all the permanent dipoles present over the entire surface of the recording layer (a) or with destruction over the entire surface of the alignment of the permanent dipoles present in each case in the individual areas of the pattern.

8. A process as claimed in claim 1 wherein the pattern of surface charges present on the recording layer (a) is toned, before erasure, at least once with a liquid or solid toner, and the resultant toner image is then transferred from the recording layer (a) to another surface.

9. A process as claimed in claim 1 wherein the pattern of surface charges present on the recording layer (a) is toned with a liquid or solid toner, and the resultant toner image is then fixed on the recording layer (a).

10. A machine which serves for the reversible or irreversible production of an image by imagewise exposure of a recording layer (a) to energy in the presence or absence of an electrical and/or magnetic field, resulting in a pattern of surface charges on the surface of the recording layer (a) corresponding to the imagewise exposure to energy, and which comprises (A) at least one recording element, containing
  (a) a recording layer and
  (b) an electroconductive substrate electrode,
(B) at least one device for imagewise exposure of the recording element (A) to energy, and
(C) at least one counterelectrode connected opposite the electroconductive substrate (b), wherein (D) the recording layer (a) consists essentially of an organic material which has a nematic liquid-crystalline, smectic liquid-crystalline or ferroelectric smectic liquid-crystalline behavior which solidifies in a glass-like manner, is not or only slightly photoconductive and contains permanent dipoles, and in which the pattern of surface charges is produced without or virtually without formation of free charge carriers by reversible imagewise alignment of all or some of the permanent dipoles present in the recording layer (a),
(E) the electroconductive substrate (b) contains at least
  (c) one dimensionally stable carrier layer,
  (d) one electrode layer and
  (e) one alignment layer, in the stated sequence one on top of the other, the recording layer (a) being directly on top of the alignment layer (e),
(F) the counterelectrode (C) is in direct contact with the recording layer (a) and is arranged in such a manner that it can be removed again from the recording element (A, D, E), and in such a manner that it has either the form of a planar or curved plate or the form of a roller which can be passed over the recording element (A, D, E) in apparent motion, and wherein
(G) the device (B) for the imagewise exposure to energy contains at least one laser light source or a thermal printing head.

11. A machine as claimed in claim 10, wherein the surface of the electrode (C, F) either serves as an alignment layer (g) or is covered by an alignment layer (g) or a polysiloxane layer (h).

12. A machine as claimed in claim 10 wherein the electrode (C, F) can be heated.

13. A machine as claimed in claim 10 wherein the recording element (A, D, E) is planar.

14. A machine as claimed in claim 10 wherein the recording element (A, D, E) has the form of a roller and can be rotated against the electrode (C, F) in the manner of a calander.

15. A machine as claimed in claim 10 which further comprises (H) at least one device for toning the pattern of surface charges produced in the recording layer
  (a) with solid or liquid toners.

16. A machine as claimed in claim 10 which further comprises (I) at least one device for transferring the toner image from the recording layer (a) to another surface.

17. A machine as claimed in claim 10 which further comprises (J) at least one device for fixing the toner image.

18. A machine as claimed in claim 10 which further comprises (K) at least one device for exposing the entire surface of the recording element (A, D, E) to energy.

19. A machine as claimed in claim 12 which further comprises (L) devices for producing electrical and/or magnetic fields which are able to pass through the recording elements (A, D, E) over the entire surface.

20. A process for the reversible or irreversible production of an image by imagewise exposure of a recording layer (a) to energy in the presence or absence of an electrical and/or magnetic field, resulting in a pattern of surface charges on the surface of the recording layer (a) corresponding to the imagewise exposure to energy, which comprises the following steps:

(1) providing a recording element consisting essentially of a 0.1 to 20 μm thick recording layer (a) which solidifies in a glass-like manner and is non-photoconductive or substantially non-photoconductive and has a nematic liquid-crystalline or enantiotropic, ferroelectric smectic liquid-crystalline ($S_c^*$) behavior and, at sufficiently high temperature by applying an external electrical field, can either be converted into a polarized nematic liquid-crystalline ordered state and frozen in this state in a glass-like manner on cooling or can be switched back and forth between two thermodynamically stable, ferroelectric smectic liquid-crystalline $S_c^*$ ordered states, and an electroconductive substrate (b), which contains layers arranged so that, from the top down, the layers are an alignment layer (e), an electrode layer (d), and a dimensionally stable carrier layer (c), the recording layer (a) being on top of the alignment layer (e) of the substrate (b);
(2) aligning the recording layer (a) over the entire surface into the polarized nematic liquid-crystalline ordered state or into one of its thermodynamically stable, ferroelectric smectic liquid-crystalline $S_c^*$ ordered states by warming the entire surface of the recording layer (a) in the electrical field between the electrode layer (d) and a counter-electrode which is arranged in such a manner that it can be removed from the recording element, is connected opposite the electrode layer (d), is in direct contact with the recording layer (a) and is covered either by an alignment layer (g) or a polysiloxane layer (h) or whose surface serves as an alignment layer (g), the counter-electrode either having the form of a curved or planar plate or the form of a roller which is passed over the recording element in apparent motion at a suitable speed;
(3) imagewise warming of the recording layer (a) aligned over the entire surface in the presence or absence of an electrical field by means of a laser beam or a thermal printing head, forming a pattern which comprises areas which are stable at room temperature, in which either a non-polarized nematic liquid-crystalline ordered state, the other thermodynamically stable, ferroelectric smectic liquid-crystalline $S_c^*$ ordered state, another liquid-crystalline ordered state, unordered microdomains (centers of scattering) or an isotropic I phase is present, and
(4) toning the pattern in the absence of an electrical field with solid or liquid toners to produce a pattern of toner images.

21. A process as claimed in claim 20, wherein (5) the toner image resulting from process step (4) is transferred from the recording layer (a) to another surface.

22. A process as claimed in claim 21, wherein (6) the pattern is erased after process step (5) by repeating process step (2).

23. A process as claimed in claim 20, wherein (7) the toner image resulting from process step (4) is fixed on the recording layer (a).

24. A process for the reversible or irreversible production of a positive image by imagewise exposure of a recording layer (a) to energy in the presence of an electrical and/or magnetic field, resulting in a pattern of surface charges on the surface of the recording layer (a) corresponding to the imagewise exposure to energy, which comprises the following process steps:

(1) application of a 0.1 to 20 μm thick recording layer (a) which is non-polarized nematic or not aligned over the entire surface, which solidifies in a glass-like manner and is not or only slightly photoconductive and has a nematic liquid-crystalline or enantiotropic ferroelectric smectic liquid-crystalline ($S_c^*$) behavior and, at sufficiently high temperature by applying an external electrical field, can either be converted into a polarized nematic liquid-crystalline ordered state and frozen in this state in a glass-like manner on cooling or can be switched back and forth between two thermodynamically stable, ferroelectric smectic liquid-crystalline $S_c^*$ ordered states, to the alignment layer (e) of an electroconductive substrate (b) which contains a dimensionally stable carrier layer (c), an electrode layer (d) and an alignment layer (e) one on top of the other, resulting in a recording element (A, D, E), (2) imagewise warming of the recording layer (a) which is non-polarized nematic or not uniformly aligned over the entire surface, in the presence of an electrical field by means of a laser beam or a thermal printing head, forming a pattern which comprises areas which are stable at room temperature in which either a polarized nematic liquid-crystalline or one of the two thermodynamically stable, ferroelectric smectic liquid-crystalline $S_c^*$ ordered states of the recording layer (a) is present, and (3) toning the pattern in the absence of an electrical field with solid or liquid toners.

25. A process as claimed in claim 24, wherein (4) the toner image resulting from the process step (3) is transferred from the recording layer (a) to another surface.

26. A process as claimed in claim 25, wherein (5) the pattern is erased after process step (4) by warming the entire surface of the recording layer (a) in the absence of an electrical field.

27. A process as claimed in claim 24, wherein (6) the toner image resulting from process step (3) is fixed on the recording layer (a).

28. A process for the production of two- or multicolor photocopies by producing a residual electrical polarization image composed of positively and negatively electrically charged areas on the surface of a recording layer (a), which comprises:

(1) application of a 0.1 to 20 μm thick recording layer (a) which solidifies in a glass-like manner and is not or only slightly photoconductive having an enantiotropic, ferroelectric smectic liquid-crystalline ($S_c^*$) behavior and, at sufficiently high temperature by applying an external electrical field, can be switched back and forth between two thermodynamically stable, ferroelectric smectic liquid-crystalline $S_c^*$ ordered states, to the alignment layer (e) of an electroconductive substrate (b), which contains a dimensionally stable carrier layer (c), an electrode layer (d) and an alignment layer (e) one on top of the other, resulting in a recording element (A, D, E), (2) alignment of the recording layer (a) over the entire surface into one of its thermodynamically stable, ferroelectric smectic liquid-crystalline $S_c^*$ ordered states by warming the entire surface of the recording layer (a) in the electrical field between the electrode layer (d) and a counterelectrode (C, F), which is arranged in such a manner that it can be removed from the recording element (A, D, E), is connected opposite the electrode layer (d), is in direct contact with the recording layer (a) and is covered either by an alignment layer (g) or a polysiloxane layer (h) or whose surface serves as an alignment layer (g), the counterelectrode (C, F) either having the form of a curved or planar plate or the form of a roller which is passed over the recording element (A, D, E) in apparent motion at a suitable speed, (3) imagewise warming of the recording layer (a) aligned over the entire surface in the presence of an electrical field by means of a laser beam or a thermal printing head, forming a residual electrical polarization image which comprises areas which are stable at room temperature in which in each case one of the two thermodynamically stable, ferroelectric smectic liquid-crystalline $S_c^*$ ordered states of the recording layer (a) is present, and (4) toning the residual electrical polarization image with two liquid or solid toners of opposite electrical charge.

29. A process for the production of two- or multicolor photocopies by producing a residual electrical polarization image composed of positively and negatively electrically charged areas on the surface of a recording layer (a), which comprises:

(1) application of a 0.1 to 20 μm thick recording layer (a) which solidifies in a glass-like manner and is not or only slightly photoconductive having an enantiotropic, ferroelectric smectic liquid-crystalline ($S_c^*$) behavior and, at sufficiently high temperature by applying an external electrical field, can be switched back and forth between two thermodynamically stable, ferroelectric smectic liquid-crystalline $S_c^*$ ordered states, to the alignment layer (e) of an electroconductive substrate (b), which contains a dimensionally stable carrier layer (c), an electrode layer (d) and an alignment layer (e) one on top of the other, resulting in a recording element (A, D, E), (2) imagewise warming of the recording layer (a) in the presence of the electrical field between the electrode layer (d) and a counterelectrode (C, F), which is arranged in such a manner that it can be removed from the recording element (A, D, E), is connected opposite the electrode layer (d), is in direct contact with the recording layer (a) and is covered either by an alignment layer (g) or a polysiloxane layer (h) or whose surface serves as an alignment layer (g), the counterelectrode (C, F) either having the form of a curved or planar plate or the form of a roller which is passed over the recording element (A, D, E) in apparent motion at a suitable speed, by means of a laser beam or a thermal printing head, forming a residual electrical polarization image which comprises areas which are stable at room temperature in which in each case one of the two thermodynamically stable, ferroelectric smectic liquid-crystalline $S_c^*$ ordered states of the recording layer (a) is present, (3) repeating process step (2) in the presence of the reversed electrical field, forming a second residual electrical polarization image which is different from the first polarization image, having opposite electrical surface charges, and (4) toning the residual electrical polarization image with at least two liquid or solid toners of opposite electrical charge.

30. A process as claimed in claim 28 or 29, wherein at least two toners are used which are optically highly contrasting.

31. A process as claimed in any of claims 1 or 20 or 24 or 28 or 29, which is carried out using a machine which serves for the reversible or irreversible production of an image by imagewise exposure of a recording layer (a) to energy in the presence or absence of an electrical and/or magnetic field, resulting in a pattern of surface charges on the surface of the recording layer (a) corresponding to the imagewise exposure to energy, and which comprises (A) at least one recording element, containing (a) a recording layer which is suitable for the process, and (b) an electroconductive substrate, (B) at least one device for imagewise exposure of the recording element (A) to energy, and (C) at least one electrode (counterelectrode) connected opposite the electroconductive substrate (b), wherein (D) the recording layer (a) consists essentially of an organic material which has a nematic liquid-crystalline, smectic liquid-crystalline or ferroelectric smectic liquid-crystalline behavior which solidifies in a glass-like manner, is not or only slightly photoconductive and contains permanent dipoles, and in which the pattern of surface charges is produced without or virtually without formation of free charge carriers by reversible imagewise alignment of all or some of the permanent dipoles present in the recording layer (a), (E) the electroconductive substrate (b) contains at least (c) one dimensionally stable carrier layer, (d) one electrode layer and (e) one alignment layer, in the stated sequence one on top of the other, the recording layer (a) being directly on top of the alignment layer (e), (F) the counterelectrode (C) is in direct contact with the recording layer (a) and is arranged in such a manner that it can be removed again from the recording element (A, D, E), and in such a manner that it has either the form of a planar or curved plate or the form of a roller which can be passed over the recording element (A, D, E) in apparent motion, and wherein (G) the device (B) for the imagewise exposure to energy contains at least one laser light source or a thermal printing head.

* * * * *